US005724075A

United States Patent [19]

Smith

[11] Patent Number: 5,724,075

[45] Date of Patent: Mar. 3, 1998

[54] INK JET BOOK SPINE PRINTING SYSTEM

[75] Inventor: Wayne R. Smith, Pittsford, N.Y.

[73] Assignee: Xerox Corporation, Stamford, Conn.

[21] Appl. No.: 436,031

[22] Filed: May 5, 1995

Related U.S. Application Data

[63] Continuation-in-part of Ser. No. 229,253, Apr. 18, 1994, abandoned.

[51] Int. Cl.[6] ..... B41J 3/00

[52] U.S. Cl. ..... 347/2

[58] Field of Search ..... 347/2, 106, 4; 270/1.02

[56] References Cited

U.S. PATENT DOCUMENTS 4,728,963 3/1988 Rasmussen et al. ..... 346/25
4,768,766 9/1988 Berger et al. ..... 270/1.02
5,174,556 12/1992 Taylor et al. ..... 347/2
5,467,973 11/1995 Graushar et al. ..... 270/1.02

FOREIGN PATENT DOCUMENTS 1283544 12/1986 Japan ..... 347/2

*Primary Examiner*—Benjamin R. Fuller
*Assistant Examiner*—L. Anderson
*Attorney, Agent, or Firm*—William A. Henry, II

[57] ABSTRACT

A system that prints onto the spine or edges of a book includes a thermal ink jet printer having a printhead configured and positioned to traverse the spine or edge of books. The ink jet printer has a book support that facilitates the positioning of a book adjacent the printhead. Imaging by the printhead onto the spine or edge of the book is controlled by a computer with appropriate software. An adjustment device is connected to the printhead for controlling the positioning of the printhead with respect to the spine or edge of the book in order to compensate for different fonts sizes and book thicknesses.

12 Claims, 5 Drawing Sheets

INK JET BOOK SPINE PRINTING SYSTEM

This is a continuation-in-part of application Ser. No. 08/229,253, filed Apr. 18, 1994, now abandoned.

BACKGROUND OF THE INVENTION

This invention relates to thermal ink jet printing and, more particularly, to a system of thermal ink jet printing of labeling onto the spine of books.

A thermal ink jet printer has at least one printhead in which thermal energy pulses are used to produce vapor bubbles in ink-filled channels and so cause droplets of ink to be expelled from the channel orifices towards a recording medium. The thermal energy pulses are usually produced by resistors, each located in a respective one of the channels, which are individually addressable by current pulses to heat and vaporize ink in the channels. As a vapor bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container. Some arrangement is usually provided to clean the channel orifices periodically while the printhead is in use and to close off the orifices when the printhead is idle to prevent the ink in the printhead from drying out.

One form of thermal ink jet printer which is incorporated herein by reference to the extent necessary to practice the present invention is described in U.S. Pat. No. 4,728,963 which provides both a paper supply tray and a paper collection tray in the front of the printer for ease of handling and reduced footprint. The paper collection tray is provided with a pair of opposed output rails which support a sheet during printing to permit ink printed onto a sheet or paper previously to dry. A paper handling mechanism is provided which picks off a sheet of paper from a stack and brings it around paper drive rollers onto a platen where the printing operation, employing a printhead cartridge occurs. One problem with this type of paper supply mechanism is the absence of a means enabling printing onto the spine of a book by the printer. This problem is particularly acute since thermal adhesive binding tape is an industry approved method of producing small quantities of bound books. Some of the approved systems use pre-cut 11" tape strips for book binding purposes that are about 1" to 3" in width. In addition, there is a need to print titles onto the spine of books (whether the spine is covered or not covered, such as, spiral bound books) that do not include thermal binding tape on the spine thereof. Some present day requirements also include the need to apply writing to all edges of a book as well.

SUMMARY OF THE INVENTION

It is an object of the present invention to provide a system by which books assembled with or without thermal adhesive binding tape can have the spine of the book labeled with the title, author, etc.

It is another object of the present invention to provide centering of printing on the spine of a book without regard to cover design.

It is yet another object of the present invention to provide a system that will print titles and other text onto the spine or edges of a wide variety of book stocks.

Accordingly, in the present invention, a thermal ink jet printer system is provided that enables a printer to print onto the spine of books that include thermal adhesive binding tape strips and other spine stock, as well as on the book edges or face. The thermal ink jet printer system includes a platform and a means for registering a book on the platform and an ink jet cartridge positioned to traverse the spine of the book in order to print particular information onto the spine. The ink jet cartridge is manipulated along the spine of the book by a personal computer adapted with appropriate word processing software. A means is provided for centering the printing onto the spine regardless of book thickness and font size.

BRIEF DESCRIPTION OF THE DRAWINGS

By way of example, an embodiment of the invention will be described with reference to the accompanying drawings, in which like parts have the same index numerals and in which.

DESCRIPTION OF THE PREFERRED EMBODIMENT

Figure 1:
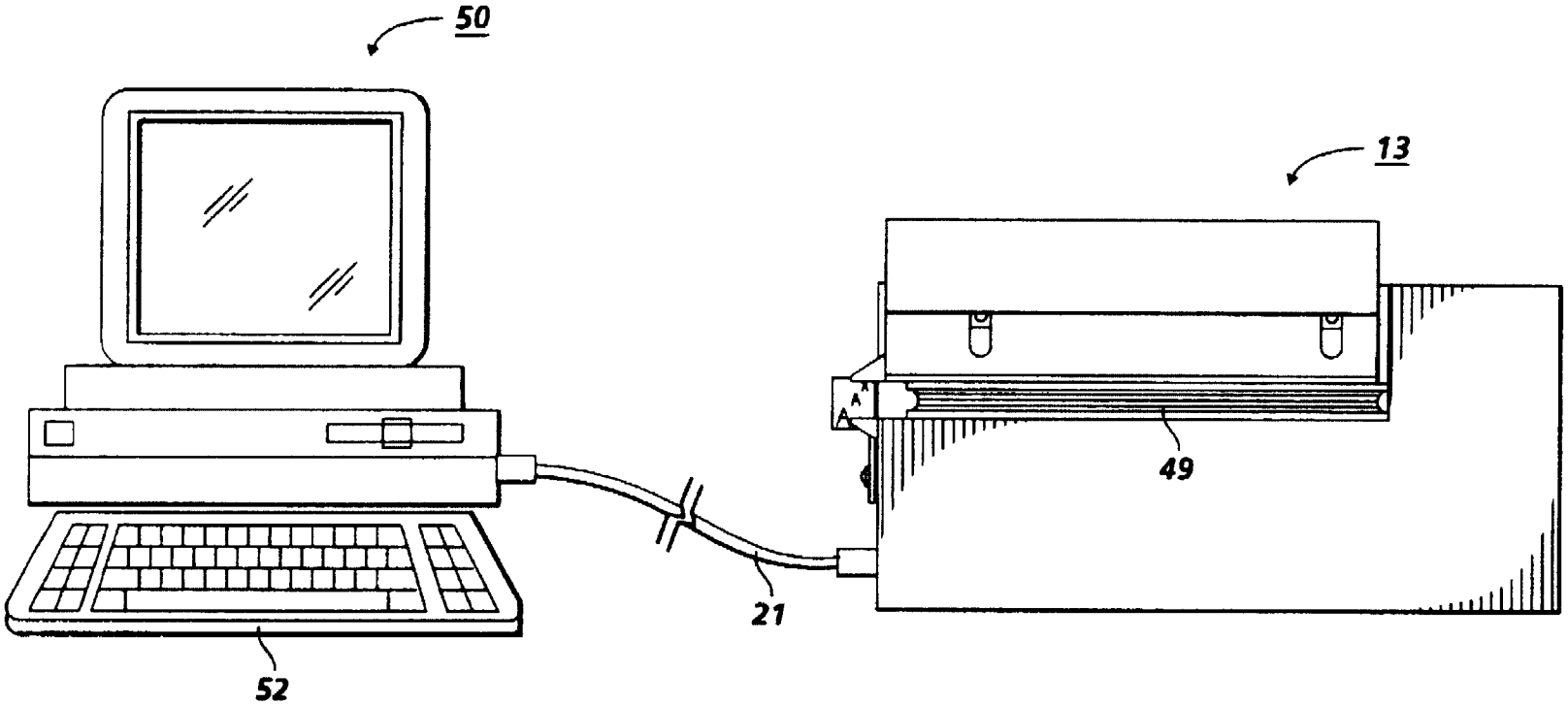
FIG. 1 is a schematic, isometric view of a thermal ink jet spine printer controlled by a computer in accordance with the present invention.
Figure 3:
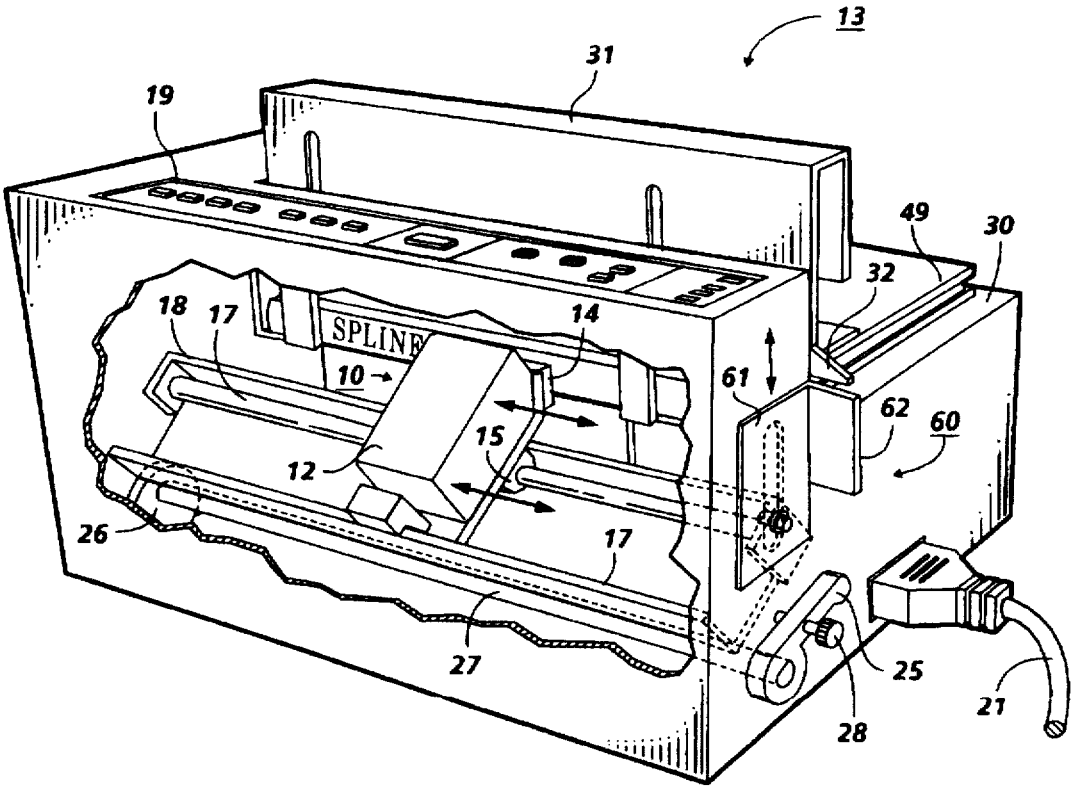
FIG. 3 is an isometric rear view of the printer of FIG. 2 with a portion cut away to allow the viewing of the movement of the printer's printhead in two directions.

FIGS. 1 and 3 are schematic, isometric views of a type of thermal ink jet printer 13 in which the printhead 14 and the ink supply therefor are combined in a single package, referred to hereinafter as cartridge 10. The main portion of cartridge 10 is the ink supply contained in housing 12, with another portion containing the actual printhead 14. Printhead 14 is preferably the Xerox ink jet head part number 8R4055 sold by Xerox Corporation, Rochester, NY and is presently in use in the Xerox® 4004® Ink Jet printer. In this embodiment of the invention, cartridge 10 is installed in a thermal ink jet printer 13 on a carriage 15 which is translated back and forth across a recording medium, such as, for example, a sheet of paper, on guide rails 17. During the translation of the printhead 14 by the carriage 15, the printhead moves relative to the recording medium and prints characters on the recording medium, somewhat in the manner of a typewriter. In the example illustrated, printhead 14 is of such a dimension that each translation of cartridge 10 along the recording medium enables printhead to print with a swath defined by the height of the array of nozzles in printhead and the width of the sheet. After each swath is printed, the sheet is indexed (by means not shown) past the printing area of the printhead, so that any number of passes of printhead 14 may be employed to generate text or images onto the sheet on line at a time. Cartridge 10 also includes means, not shown, by which digital image data may be entered into the various heating elements (not shown) of printhead 14 to print out the desired image. This means may include, for example, plug means which are incorporated in the cartridge 10 and which accept a bus from the data processing portion 16 of the apparatus, and permit an operative connection therefrom to the heating elements in the printhead 14.

Figure 2:
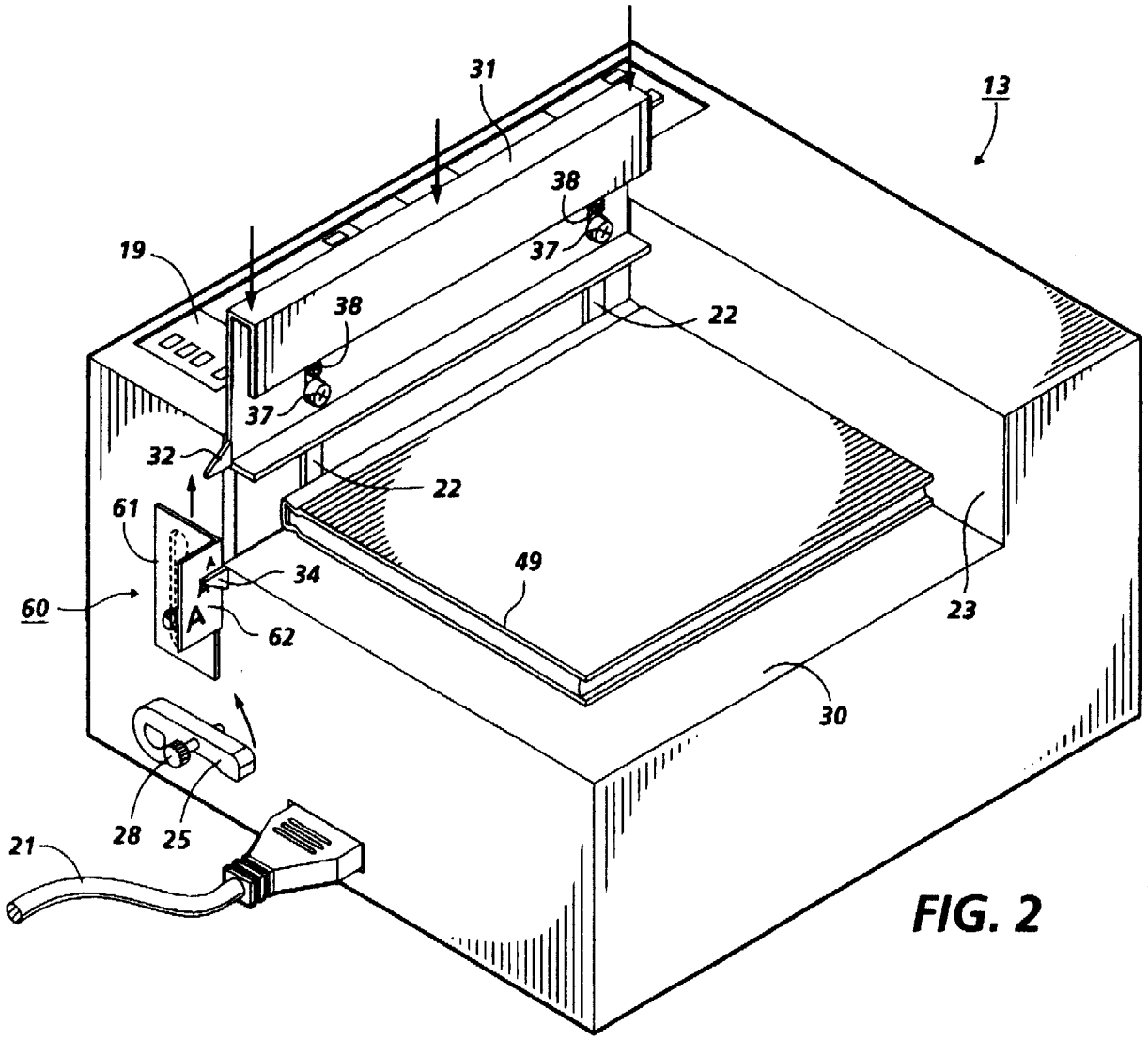
FIG. 2 is an isometric view of the thermal ink jet spine printer in accordance with the present invention.

Printers of this type are fine for printing full widths of 8½"×11" pages fed from a cassette or a platform, however, these printers are not capable of printing onto thermal adhesive binding tape (e.g., the 1¾"×11") that is used to cover the spine of printed books because once the tapes are bound to a book, the book cannot be fed through the printer. And if one is not desirous of printing onto tape bound books, but onto the spine of conventionally covered books, the problem is the same, that is, the book cannot be fed through the printer for printing onto the spine. To answer this need for a modified thermal ink jet printer that will enable the printer to print onto narrow thermal adhesive binding tape strips and the spine of various other book sizes and thicknesses, thermal ink jet printer 13 is shown in FIG. 1 communicatively attached by cable 21 to a 386 or better conventional personal computer 50 that is manipulated by keyboard 52. The printer in FIG. 2 is configured with a horizontal platform 30 onto which a book 49 is laid with the spine portion of the book 49 registered against registration stops 22 and wall 23. Registration of the spine of the book against the stops and one side of the book against wall 23 places the spine of the book adjacent the printhead and through appropriate software facilitates printing on the spine of the book with the printhead having to move back and forth along the appropriate width of the book. Conventional available word processing software, such as, copyrighted WORDPERFECT software sold by COREL has the range of sizes and faces of fonts and control over print placement and orientation to make this an effective platform for controlling printing of the printer as required.

Figure 4:
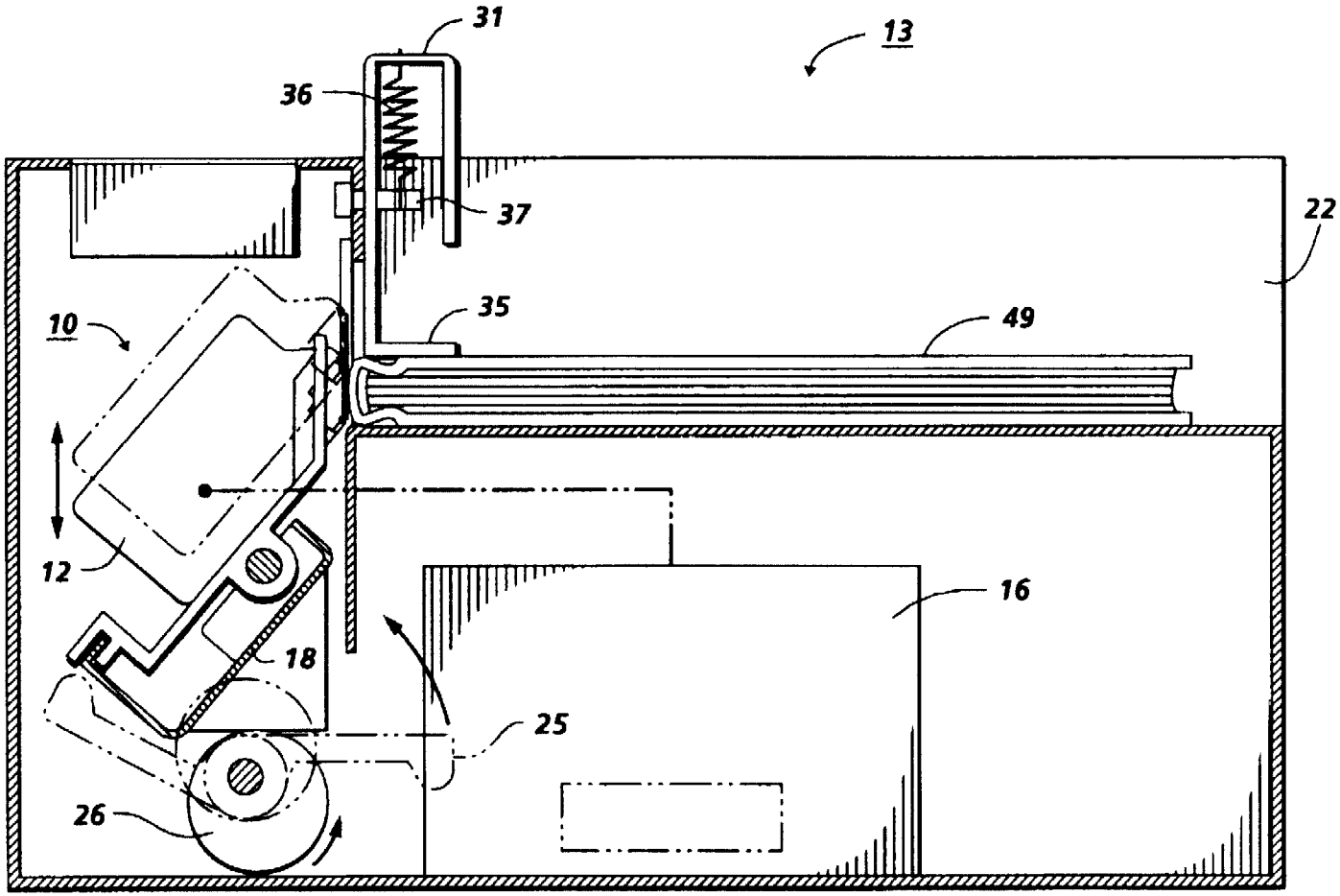
FIG. 4 is a side view of the printer of FIG. 2 showing book placement and printhead movement.

A book stabilizer member 31 in FIGS. 2 and 4 is adapted to accommodate a wide variety of book thicknesses by the use of a tension spring 36 that is connected to the stabilizer member 31 and a stud 37 which protrudes through slots 38 in the stabilizer member. The stabilizer member includes an orthogonal portion 35 that actually rests on top of a book. The stabilizer member is lifted for the insertion of a book against stops 22 and wall 23 and then slowly released to be influenced by spring 37 as portion 35 comes to rest on top of book 49. A triangular shaped member 32 protrudes form the stabilizer member and is used in conjunction with another triangular member 34 which protrudes from the housing of printer to help in centering print on the spine of the book. Centering of the print on the spine of a book is necessary because of the different font sizes available and the different thickness of books. In order to accomplish spine print centering, a centering device 60 is included with printer 13 which comprises a vertically movable plate 61 that is attached to the housing of the printer adjacent protruding members 32 and 34. Plate 61 had an orthogonal portion 62 with several different font sizes of the same letter written thereon. Plate 62 is also connected to the print head support 18 and adapted to moved vertically by manipulation of lever 25. Lever 25 has cam members 26 to it by way of rod 27 and as lever 25 is turned from a home position as shown in FIGS. 2 and 3 to an actuating position as shown in FIG. 4, the cams contact housing 18 and thereby lifts the print head 12 in a vertical direction with respect to the spine of book 49 for centering of a particular font size on the spine of the book. This lifting also moves plate 61 and the different fonts relative to protruding members 31 and 34.

In operation of the above-described ink jet book spine printing system, stabilizer member 31 is lifted with one hand and a book is placed onto platform 30 and registered against stops 22 and wall 23 with one's other hand and then stabilizer member 31 is released to rest on top of the book. Data to be printed onto the spine of the book is sent to the printer from computer 50. Knowing the font size of the print desired to be placed onto the spine of the book based on the data inputted to computer 50, lever 25 is turned counter clockwise in order to move the printhead and orthogonal portion 62 with the various font sizes vertically with respect to the spine of the book. The operator then eyeballs the predetermined font and the spine using protruding members 32 and 34 as a guide and centers the predetermined font with the spine of the book and lever 25 is released. The lever is adapted to stay in place until it is manipulated again. Through the use of screw 28, lever 25 can be moved when the screw is turned counter clockwise and held against movement when the screw is turned clockwise. The spine printer is caused to print onto the spine of the book by use of control panel 19.

Figure 5:
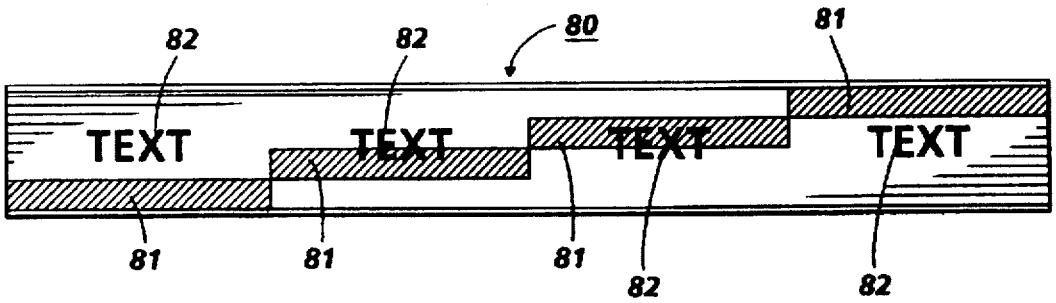
FIG. 5 is a front elevation view of a book that includes ink jet printed text descriptors of bleed tabs.
Figure 6:
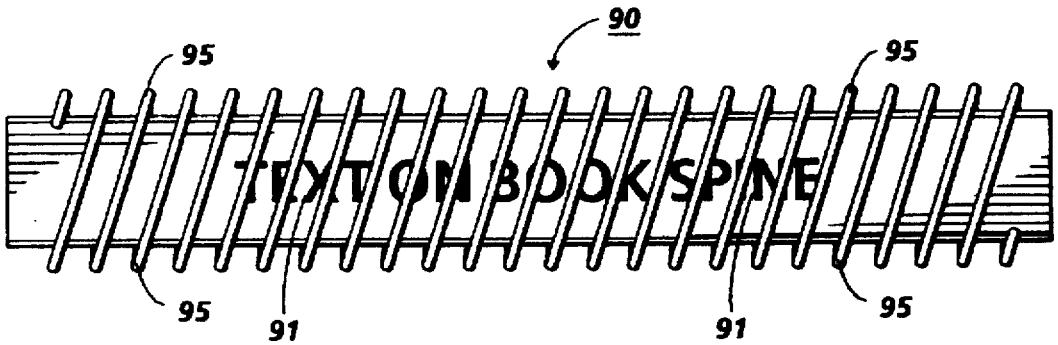
FIG. 6 is a rear elevation view of a sprial bound book having ink jet printing on its spine.

As shown in FIG. 5, the heretofore described ink jet book spine printing system is adaptable to printing on all edges of a book including the front edge of book 80 as shown by simply placing the edge of the book that printing is desired adjacent the print head. Bleed or index tabs 81, for example, are placed on pages of book 80 before they are assembled into the book and printer 13 prints a descriptor 82 in text form of each tab section of the book along the center line of the particular edge of the book. Printer 13 can also be used to provide edge print to a coil, spiral or wire bound document as shown in FIG. 6 by printing text 91 on the spine of the book 90 before assembly with coil 95 or other means or on other edges of the book before or after assembly.

It should now be apparent that an on-demand edge printer has been disclosed that can print on any edge of any member or material having a thickness of from about 3 mm up to about 140 mm. The ink jet printer of the present invention is adapted to spray ink onto any surface placed opposite to or in front of it that is suitable to receiving the ink. For example, one could print price codes, as well as, other information onto the ends or side edges of lumber, if desired.

Many modifications and variations are apparent from the foregoing description of the invention and all such modifications and variations are intended to be within the scope of the present invention.

We claim:

1. A system that enables printing onto a spine portion of books by an ink jet printer, comprising:

an ink jet printer having a printhead and a support member for supporting a book in a substantially horizontal position, said book including a spine portion and edge portions, said ink jet printer including at least two registration members for registering said spine portion of said book in a predetermined position with respect to said printhead;

guide members for supporting said printhead for transverse movement with respect to said spine portion of said book;

an adjustable centering mechanism connected to said printhead for centering print on said spine portion of the book; and a computer operatively connected to said ink jet printer to provide command signals to said printhead of said ink jet printer in order for said ink jet printer to print text onto said spine of said book.

2. The system of claim 1, including a keyboard for inputting desired text into said computer.

3. The system of claim 1, including a normal force member for applying a normal force to the book once it has been place onto said support member.

4. The system of claim 1, wherein said adjustable centering mechanism further comprises a lever connected to a plurality of cams with said cams being adapted to move said printhead when said lever is manipulated.

5. A system that enables printing onto a member having an ink compatible surface, comprising:

an ink jet printer having a printhead and a support member for supporting said member such that said ink compatible surface has a portion thereof in substantially orthogonal position with respect to said printhead, said ink jet printer including at least two registration members for registering said member in a predetermined position with respect to said printhead;

guide members for supporting said printhead for transverse movement with respect to said portion of said member an adjustment mechanism for varying positioning of said printhead with respect to said portion of said member in accordance with a size of font used to print on said portion; and a computer operatively connected to said ink jet printer to provide command signals to said printhead of said ink jet printer in order for said ink jet printer to print text onto said portion of said member.

6. The system of claim 5, including a keyboard for inputting desired text into said computer.

7. The system of claim 5, including a normal force member for applying a normal force to said member once it has been place onto said support member.

8. The system of claim 5, wherein said adjustment mechanism comprises a lever connected to a plurality of cams with said cams being adapted to move said printhead when said lever is manipulated.

9. A system that enables printing onto a spine portion or a predetermined edge portion of book, comprising:

an ink jet printer having a printhead and a support member for supporting said book in a substantially horizontal position, said ink jet printer including at least two registration members for registering said spine portion or said predetermined edge portion of the book in a predetermined position with respect to said printhead;

guide members for supporting said printhead for transverse movement with respect to said spine portion or said predetermined edge portion of the book;

an adjustable centering mechanism connected to said printhead for centering print on said spine portion or said predetermined edge portion of the book; and a computer operatively connected to said ink jet printer to provide command signals to said printhead of said ink jet printer in order for said ink jet printer to print text onto the spine the predetermined edge portion of the book.

10. The system of claim 9, including a keyboard for inputting desired text into said computer.

11. The system of claim 9, including a normal force member for applying a normal force to the book once it has been place onto said support member.

12. The system of claim 9, wherein said adjustment mechanism comprises a lever connected to a plurality of cams with said cams being adapted to move said printhead when said lever is manipulated.

* * * * *